US006200028B1

(12) United States Patent
Buchanan

(10) Patent No.: US 6,200,028 B1
(45) Date of Patent: Mar. 13, 2001

(54) CONVERTIBLE PACKAGE AND BOWL TYPE CONTAINER

(75) Inventor: Jerry E. Buchanan, Acworth, GA (US)

(73) Assignee: Technical Developers, Inc., Marietta, GA (US)

( * ) Notice: Subject to any disclaimer, the term of this patent is extended or adjusted under 35 U.S.C. 154(b) by 6 days.

(21) Appl. No.: 08/934,826

(22) Filed: Sep. 22, 1997

(51) Int. Cl.[7] ..... B65D 33/16

(52) U.S. Cl. ..... 383/63; 383/33; 383/35; 383/65; 383/104

(58) Field of Search ..... 383/63, 61, 104, 383/33, 34, 34.1, 35, 65

(56) References Cited

U.S. PATENT DOCUMENTS

| | | | | |
|---|---|---|---|---|
| 1,514,034 | * | 11/1924 | Carr | 383/35 X |
| 2,092,858 | | 9/1937 | Richard . | |
| 2,162,258 | | 6/1939 | Hultin . | |
| 2,821,337 | | 1/1958 | Morgan, Jr. . | |
| 3,319,540 | | 5/1967 | Stengle, Jr. . | |
| 3,426,814 | * | 2/1969 | Bundy | 383/63 X |
| 3,580,486 | | 5/1971 | Kugler . | |
| 3,652,006 | | 3/1972 | Trewella . | |
| 3,690,545 | | 9/1972 | Plazze . | |
| 4,082,216 | | 4/1978 | Clarke . | |
| 4,175,603 | * | 11/1979 | Iaboni et al. | 383/34 X |
| 4,428,477 | | 1/1984 | Cristofolo . | |
| 4,498,591 | * | 2/1985 | Smith, II | 383/35 X |
| 4,810,109 | | 3/1989 | Castel . | |
| 4,837,849 | | 6/1989 | Erickson et al. . | |
| 4,904,093 | | 2/1990 | Woods et al. . | |
| 5,033,867 | | 7/1991 | Peppiatt . | |
| 5,037,138 | * | 8/1991 | McClintock et al. | 383/34 |
| 5,174,658 | * | 12/1992 | Cook et al. | 383/63 X |

FOREIGN PATENT DOCUMENTS

| | | | | |
|---|---|---|---|---|
| 1090700 | * | 4/1955 | (FR) | 383/65 |
| 4651 | * | 1/1990 | (JP) | 383/61 |

* cited by examiner

*Primary Examiner*—Jes F. Pascua
(74) *Attorney, Agent, or Firm*—Baker, Donelson, Bearman & Caldwell

(57) ABSTRACT

A convertible package and bowl type container (10) has two overlaying sheets joined along their side edges by side seals (13) and folded to form container sides (19), container ends (20), a generally square bottom (14). The container has an elongated openable seal along the top of the two sides. The sides are of a height of between one to two times that of the major side dimension of the bottom. The container is reconfigurable between a closed configuration with the top seal closed and an open, self standing configuration with a squared off open top.

6 Claims, 2 Drawing Sheets

CONVERTIBLE PACKAGE AND BOWL TYPE CONTAINER

TECHNICAL FIELD

This invention relates generally to flexible containers, and more specifically to new types of flexible containers that are convertible between a closed package configuration and an open top, self standing bowl configuration.

BACKGROUND OF THE INVENTION

Containers made of flexible materials have been designed to package liquids, granular material and flake material. These containers are typically designed as pouches having two overlaying sides which are sealed along their sides, top and bottom edges. The pouch is usually opening by tearing the top seal although some pouches have resealable, mechanical interlocking seals that are capable of being resealed.

Flexible containers of these types however are typically ill-suited for serving as bowls, once opened, as they are not self standing. Thus once opened they must either be hand held uprightly or laid carefully down with their tops crimped to prevent spillage.

The two sided construction of these containers provide an elongated, relatively narrow top opening which has the tendency to remain closed and thus hamper ready access to the contents. For these reasons the contents within these pouches are typically poured into another container which is more suitable for serving the contents such as a conventional rigid bowl, tray or serving dish. Also, should the contents not be completely consumed the product is typically placed back into the pouch. This repouring of the contents is both messy and an inefficient use of two separate containers.

It thus is seen that a distinct advance could be achieved if a container could be devised which has the benefit of traditional flexible packaging and yet which could also be readily converted into an effective serving bowl. It is to the provision of such that the present invention is primarily directed.

SUMMARY OF THE INVENTION

In a preferred form of the invention, a convertible package and bowl made of flexible sheet material has a generally rectangular bottom that may assume a flat shape, and two opposed sides sealed together by two oppositely disposed side seals that extend upwardly and diverge outwardly from each other from adjacent the bottom. The two sides are sealed together at their top ends by an openable top seal. The ratio of the height of the sides to the larger width dimension of the rectangular bottom is less than 2 to 1. With this construction, the package may be set uprightly and the top seal opened with the two sides pulled apart into a generally squared off configuration forming a bowl, all while the contents are held therein.

DETAILED DESCRIPTION

Figure 1:
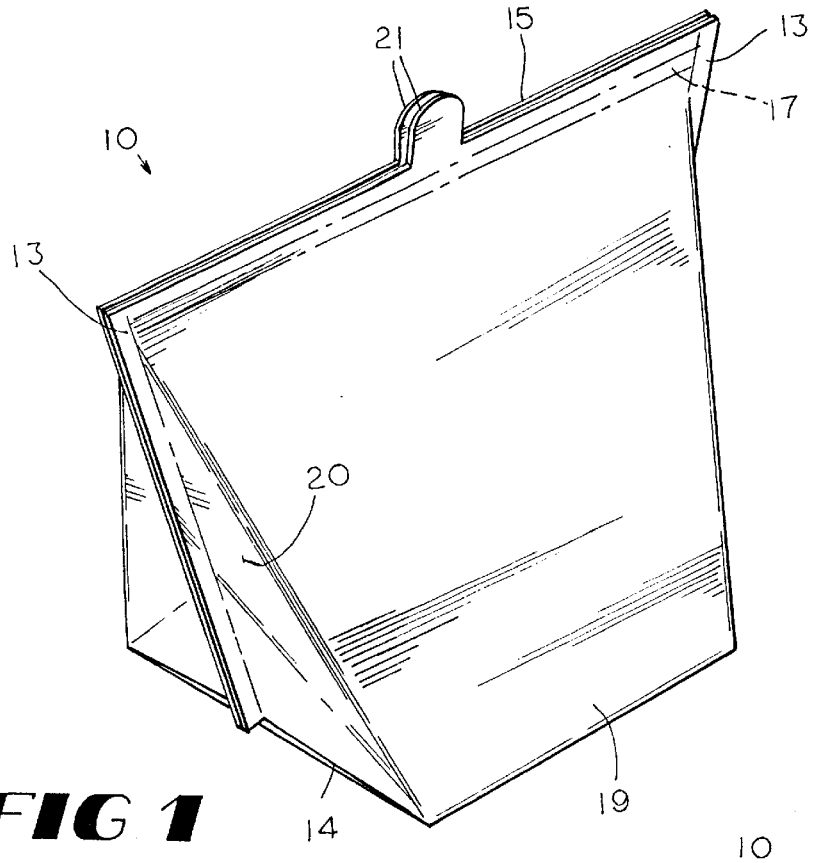
FIG. 1 is a perspective view of a convertible package and bowl type container embodying principles of the invention in a preferred form, shown in a closed configuration.

With reference next to the drawings, there is shown a convertible package and bowl type container 10 formed of a web of flexible sheet material. The material here is of two ply construction having a heat sealable inner plastic layer, such as polyethylene or polypropylene, and an imprintable plastic outer layer such as nylon or polyester. The container has two overlaying sheets 11 joined along their side edges by side seals 13, a generally square bottom 14, and an elongated top opening 15 having a mechanically interlocking top seal 17. The bottom may be square. If not square one side should not be more than 50% its contiguous side. The side seals 13 diverge upwardly from the bottom 14 to the ends of the top opening 15.

The two sheets 11 of the container are folded along lines extending from the corners of the bottom to the ends of the top seal so that the container sides 19 are of a generally trapezoidal shape while the container ends 20 are of a generally triangular shape. The top end of each side 19 has a pull tab 21 extending from its center. To achieve the general configuration of the body as shown in FIG. 1, flexible sheet material may be folded and sealed in a series of manufacturing steps as shown in U.S. patent application Ser. No. 08/912,821. However, it has now been discovered that by limiting the height of the sides to less than twice the width of the bottom of the package and providing an elongated, openable seal along the tops of the two sides, the flexible container may be opened widely into a generally squared off configuration and remain so opened.

Figure 3:
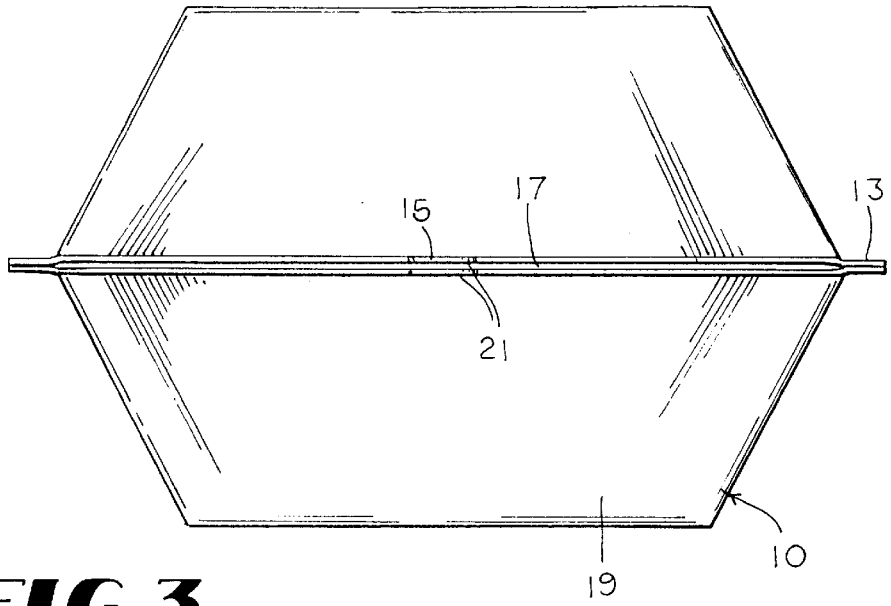
FIG. 3 is a top view of the container of FIG. 1 showing the container in a closed configuration.
Figure 4:
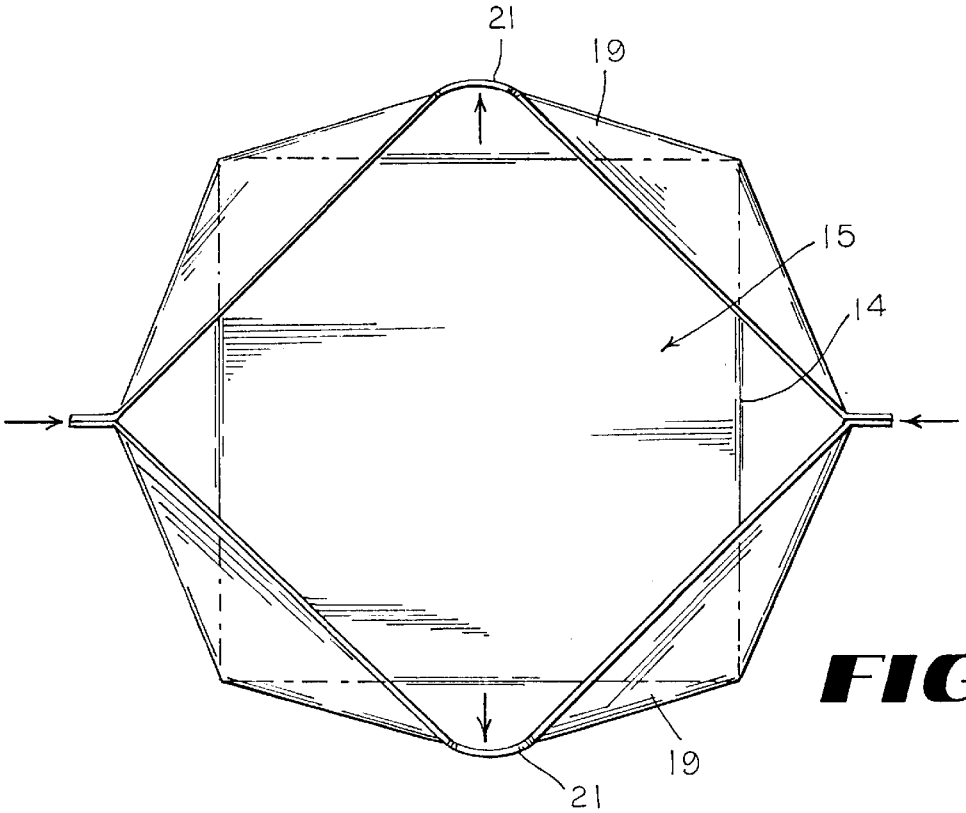
FIG. 4 is a top view of the container of FIG. 1 showing the container squared off top opening in relation with the square bottom.

In use, the top seal 17 is maintained closed during shipment and storage of the containers and its contents. To convert the package to a bowl the top seal 17 is opened by manually pulling the top tabs 21 apart whereupon the top of the container assumes a generally squared off, open configuration shown in FIGS. 2 and 4. The squared off top or rim is oriented approximately 45° to the orientation of the rectangular bottom as shown in FIG. 4. The outward movement of the tabs, and thus the center of the sides 19 too, causes their side seals to be drawn inwardly almost to a mutually parallel position. This drawing in of the upper portion of the side seals is accompanied by a flaring out of the central portions of the open top rim. This is best illustrated in FIGS. 3 and 4. The novel construction of the container retains this generally squared off open top configuration once the manual force is eliminated. As such, the contents within the container are readily accessible through the widely open top without having to transfer the contents to another serving container.

Figure 2:
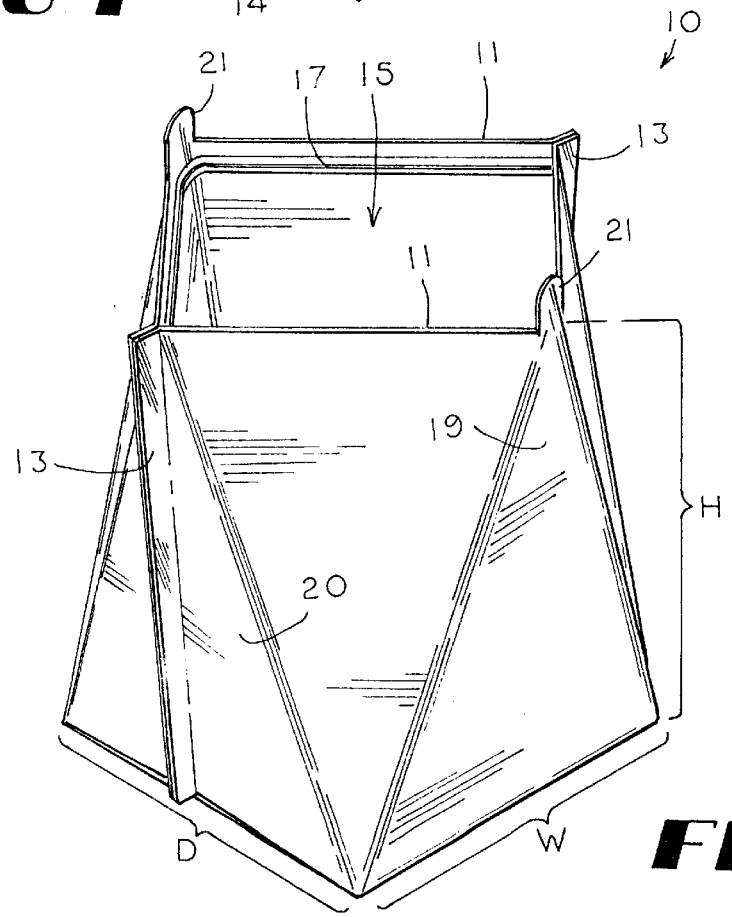
FIG. 2 is a perspective view of the container of FIG. 1, shown in an open, self standing configuration indicating the strutting effect of the folded plastic material.

The open configuration of the container causes each of the container's trapezoidal-shaped sides 19 to be folded so as to form a series of three alternating direction sectional triangles, as best shown in FIG. 2. The formation of the folds F, which define these triangles, creates a strutting effect that increases the upright rigidity of the container. This enhanced vertical integrity impedes the container from being crushed downward by hands reaching therein for the contents. Additionally, the folding of the sides causes the top edge of the sides to also assume a V-shape configuration which restricts the inward or closing movement of the middle portion of the sides.

It should be noted that the height H of the container is less than twice the width W of the container bottom. This feature is critical in that it has been found that a height greater than twice the width will tend to cause the container top opening to close while a height less than half the width does not provide an economically adequate container volume. The preferred ratio is 1 to 1.5 for containers with a square bottom and 1 to 1.5 for containers with a non-square rectangular bottom. However, a non-square bottom should be limited to rectangular shaped wherein the sides do not vary more than 50% from each other in length. For should the shorter side vary by more than 50% the longer side then the top opening of the container will tend to close. The side seals of the container should also be between 100° and 130° from the bottom to enable the proper drawing in of the side seals with the outward movement of the tabs. For, if the side seal angle is too small the container will tend to close itself, while if the angle is too large the container volume is inadequate and the container itself will again tend to close itself. Also, it should be understood that even though a mechanical interlocking seal has been shown, other types of elongated seals could be employed.

From the foregoing, it is seen that a flexible container is now provided that may be readily converted between a package and self standing bowl configurations all while holding contents therein. Thus, for example, a sealed pack of candies may be sold as retail, taken home, and the package opened and set uprightly as a bowl with ready access to the candies. Later, it may be resealed. Granular materials as well as liquids may also be handled in this manner.

Although the invention has been shown and described in its preferred form, it should be understood that many modifications, additions and deletions may, of course, be made thereto without departure from the spirit and scope of the invention as set forth in the following claims.

What is claimed is:

1. A convertible package and bowl made of flexible sheet material and having a generally rectangular bottom that may assume a flat shape, two opposed sides sealed together by two oppositely disposed side seals that extend upwardly and diverge outwardly from each other from adjacent said bottom, said two sides being also sealed together at their top ends by an openable top seal, and wherein the ratio of the height of said sides to the larger width of said generally rectangular bottom is less than 2 to 1, whereby the package may be set uprightly and the top seal opened with the two sides pulled into a generally squared off configuration forming a bowl all while the contents are held therein.

2. The convertible package and bowl of claim 1 wherein said two sides top seal is a mechanically interlocking seal.

3. The convertible package and bowl of claim 1 wherein each of said sides has a pull tab adjacent said top seal.

4. A self sealable bowl comprised of flexible sheet material having a rectangular bottom from opposite sides of which generally trapezoidal shape sides extend and from opposite ends of which two triangular-shaped ends extend between said sides, means for resealable sealing the tops of said sides together along an elongated seal, and wherein the ratio of the height of said generally trapezoidal shape sides to the larger width of said rectangular bottom is less than 2 to 1, whereupon unsealing the top seal and manually spreading the tops of the sides apart, a self standing bowl is formed with a wide open top.

5. The self sealable bowl of claim 4 wherein said sealing means comprises a mechanically interlocking seal.

6. The self sealable bowl of claim 4 wherein each of said sides has a pull tab adjacent said seal means.

* * * * *